US008733504B2

(12) United States Patent
Mauthner

(10) Patent No.: US 8,733,504 B2
(45) Date of Patent: May 27, 2014

(54) METHOD AND APPARATUS FOR A COMPACT DESCENDER

(75) Inventor: Kirk Martin Mauthner, Wilmer (CA)

(73) Assignee: Kirk Mauthner, Invermere, British Columbia (CA)

( * ) Notice: Subject to any disclaimer, the term of this patent is extended or adjusted under 35 U.S.C. 154(b) by 37 days.

(21) Appl. No.: 13/374,797

(22) Filed: Jan. 17, 2012

(65) Prior Publication Data

US 2013/0180800 A1 Jul. 18, 2013

(51) Int. Cl.
*A62B 1/00* (2006.01)

(52) U.S. Cl.
USPC ..... 182/191; 182/5; 188/65.5

(58) Field of Classification Search
USPC ..... 182/5, 192, 193, 3, 235, 6–7, 241; 188/65.3–65.5, 65.1–65.2
See application file for complete search history.

(56) References Cited

U.S. PATENT DOCUMENTS

| | | | | | |
|---|---|---|---|---|---|
| 2,187,361 | A * | 1/1940 | Palsson | 188/65.1 |
| 4,596,314 | A * | 6/1986 | Rogelja | 188/65.5 |
| 5,054,577 | A * | 10/1991 | Petzl et al. | 182/5 |
| 5,597,052 | A * | 1/1997 | Rogleja | 188/65.5 |
| 5,850,893 | A * | 12/1998 | Hede et al. | 182/193 |
| 5,954,153 | A * | 9/1999 | Rogelja | 182/5 |
| 6,155,384 | A * | 12/2000 | Paglioli | 188/65.2 |
| 6,732,833 | B2 * | 5/2004 | Rogelja | 182/5 |
| 6,902,031 | B2 * | 6/2005 | Ador | 182/5 |
| 7,419,138 | B1 * | 9/2008 | Mauthner | 254/394 |
| 7,658,264 | B2 * | 2/2010 | Mauthner | 182/5 |
| 7,845,467 | B2 * | 12/2010 | Petzl et al. | 182/5 |
| 8,375,526 | B2 * | 2/2013 | Everett | 24/132 R |
| 2002/0112917 | A1 * | 8/2002 | Ador | 182/5 |
| 2003/0075392 | A1 * | 4/2003 | Rogelja | 188/65.5 |
| 2006/0207829 | A1 * | 9/2006 | Mauthner | 182/5 |
| 2007/0215411 | A1 * | 9/2007 | Petzl et al. | 182/193 |
| 2009/0120720 | A1 * | 5/2009 | Arms | 182/193 |
| 2011/0073417 | A1 * | 3/2011 | Chaumontet et al. | 188/65.5 |
| 2012/0012422 | A1 * | 1/2012 | Herrli | 182/5 |
| 2012/0048651 | A1 * | 3/2012 | Rinklake | 182/234 |
| 2012/0118666 | A1 * | 5/2012 | Raoul Bingham | 182/5 |

OTHER PUBLICATIONS

Definition of 'By' Provided in Action The American Heritage® Dictionary of the English Language, Fourth Edition copyright © 2000 by Houghton Mifflin Company. Updated in 2009. Published by Houghton Mifflin Company. All rights reserved.*

* cited by examiner

*Primary Examiner* — Daniel Cahn

(57) ABSTRACT

Method and Apparatus for a Compact Descender used in conjunction with a rope. The invention includes a first plate and a second plate arranged adjacent to one another and pivotally connected to one another by a rope post at the top ends of the first plate and the second plate. The first plate and the second plate are selectively and pivotally opened and closed and are interlocked when closed by attachment of a carabiner through a hole in the bottom end of the first plate and an adjacent hole in the bottom end of the second plate. The first plate and the second plate include a rope channel adjacent to a lever, where the lever is pivotally attached to a pivot pin affixed to the first plate. A substantially rectangular shaped rope clamping cam is pivotally attached above the lever on the same pivot pin.

2 Claims, 7 Drawing Sheets

METHOD AND APPARATUS FOR A COMPACT DESCENDER

FIELD OF INVENTION

This invention relates generally to a method and device for descending on a rope and more particularly, to a compact auto clamping rope descender with lever action release or belay for a single person load. It can also be used as a "ratchet" or "progress capture" in an ascent system or within a pulley system.

BACKGROUND

Rope descenders as used for descending when rock climbing, rescuing or, professional ski guides, or for mission specific military special operations or, tactical operations personnel purposes, are generally well known, whereas the present invention offers unique properties, the advantages of which are listed below in the Summary of the Invention.

Past inventions that include descenders and which incorporate some or part of the basics of the present invention are numerous. Inventors are aware of U.S. Pat. No. 6,902,031 issued to Ador, Jun. 7, 2005 entitled, Personal safety device for a vertical rope; U.S. Pat. No. 5,850,893 issued to Hede, et al., Dec. 22, 1998 entitled, Self-locking descender for a rope with an operating lever; U.S. Pat. No. 5,577,576 issued to Petzl, et al. Nov. 26, 1996 entitled, Disengageable descender with self-locking of the rope; U.S. Pat. No. 5,054,577 issued to Petzl, et al. Oct. 8, 1991 entitled, Self-jamming descender for a rope with two jamming positions; and U.S. Pat. No. 4,580,658 issued to Brda Apr. 8, 1986 entitled Device for lowering a person or a load on a rope; all of which are listed here for reference purpose only.

SUMMARY OF THE INVENTION

This unique design of rope descender allows a more compact personal use configuration comprising a rectangular shaped cam, combined with 360 degrees of wrap around the cam, along with an adjacent friction post or rope post and the connectivity of the lever to the cam, and further combining the unique compound angle lever and V-groove arrangement that achieves maximum control in a personal use device.

In using compact descender the rope is loaded by swinging the front plate to fully expose the rectangular shaped cam and rope channel. The rope is wrapped 360 degrees counterclockwise around the rectangular cam, with both the standing part and running end (the free end) exiting on the left hand side of the cam and rope post. Close the front plate such that the front and rear plate carabiner holes align and the running end of the rope is positioned in the V-groove shape formed by the two plates when closed.

Clip a locking carabiner through both holes and then orient the compact descender with the lever facing away from the body; then clip the carabiner through to the rappel loop of the harness. Ensure that the running end is still in the V-groove, apply a firm grip to the running end with one hand, and with the other hand wrap it around the device placing the palm of your hand on the lever and your thumb on the other side of the device. Slowly squeeze the lever in towards the device to initiate descent. The desired rate of descent is achieved by a combination of how far the lever is squeezed and how firmly the running end is gripped.

Maximum rate of descent occurs when the lever has rotated the cam away from the rope post. If the lever is rotated further, friction is then applied to the rope by the lever forcing the running end rope further into the V-groove thereby providing an additional means of descent control.

It should be mentioned that the compact descender can also be used to lower a person rather than rappelling. The mechanics of descent control for lowering are essentially the same as rappelling except that the descender is clipped to an anchor instead of to the rappel loop. It can also be used as a "progress capture" in an ascent system or within a pulley system.

A principal object of the invention is to provide a compact device that is versatile, enabling various descending and other uses when combined with additional mechanical riggings.

Another object of the invention is to provide an apparatus that can be quickly and easily attached to a rope and easily enabled into use. Another object of the present invention is to provide an improved device where the compact size makes it easy to carry.

A further object is to provide a device that is durable in use and yet cost effective to market.

The present invention has other objects and features of advantage, which will become apparent from and are set forth in more detail in the description and the accompanying drawings.

BRIEF DESCRIPTION OF DRAWINGS

Advantages of the present invention will become more fully appreciated as the same becomes better understood when considered in conjunction with the following detailed description of an illustrative embodiment and accompanying drawings, in which like reference characters designate the same or similar parts throughout the several views, wherein.

DETAILED DESCRIPTION OF THE PREFERRED EMBODIMENTS

Figure 1:
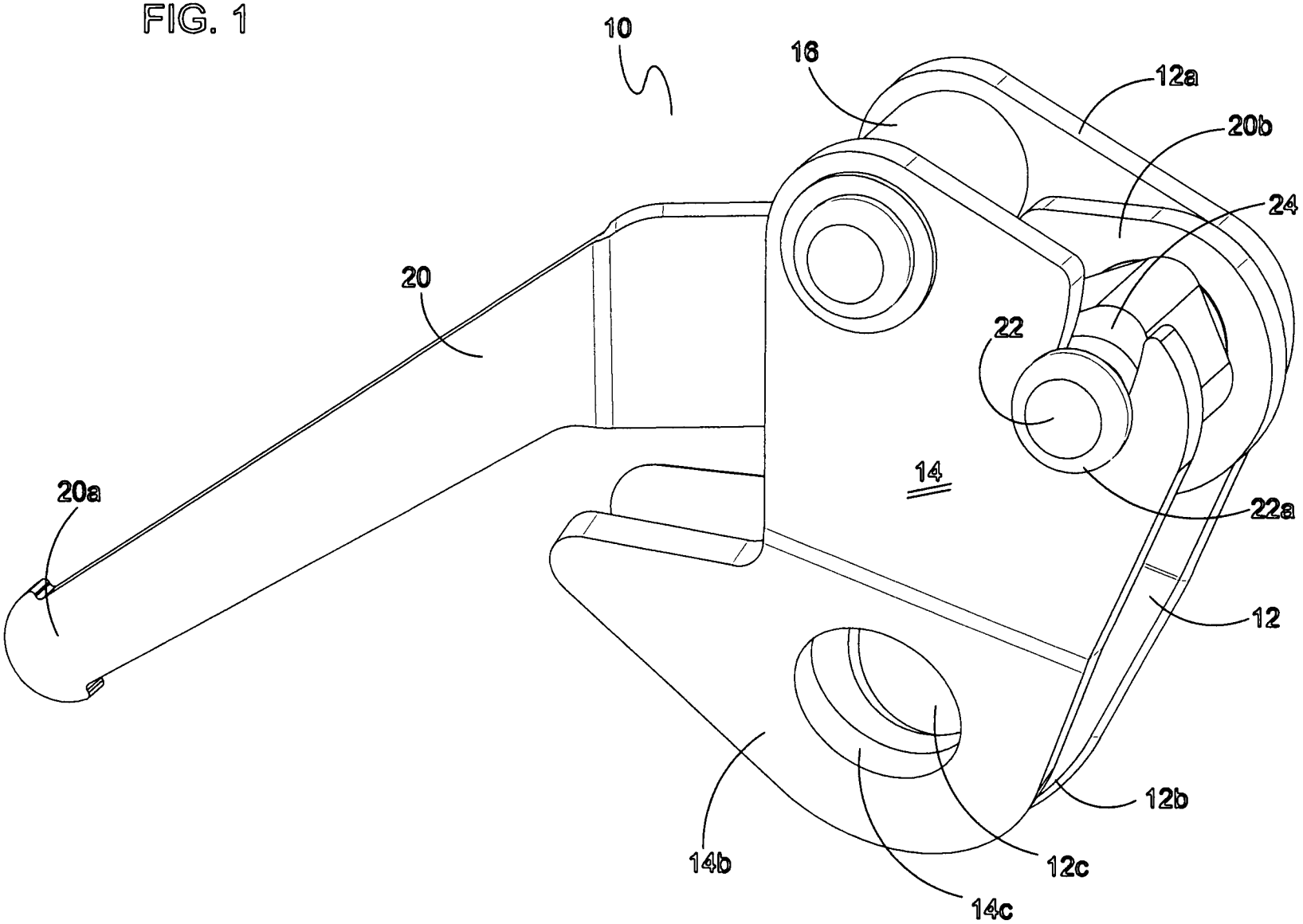
FIG. 1 is a front perspective view of the apparatus for a compact descender according to the preferred embodiment of the present invention.

Referring to FIG. 1 where a front perspective view shows the compact descender apparatus, which is generally referred to here as device 10. Device 10 includes a rear plate 12 and a front plate 14. Rear plate 12 has a top end 12*a* and a bottom end 12*b*. Front plate 14 has a top end 14*a* and a bottom end

14*b*. Rear plate 12 and a front plate 14 are arranged opposing one another and are pivotally connected to one another by a rope post 16. Device 10 includes a rope channel 18. Adjacent to rope channel 18 is a lever 20, lever 20 includes a handle end 20*a* and a pivot end 20*b*, where lever pivot end 20*b* is pivotally attached to rear plate 12 by a pivot pin 22. Also pivotally attached to pivot pin 22 is a rope clamping cam 24. Pivot pin 22 includes a shoulder 22*a* to increase rigidity of device 10 when rear plate 12 and the front plate 14 are interconnected in the closed position. Also, when rear plate 12 and the front plate 14 are in the closed position holes 12*c* and 14*c* are align with one another for interlocking of rear plate 12 and the front plate 14 by a carabiner clip (not shown).

Figure 2:
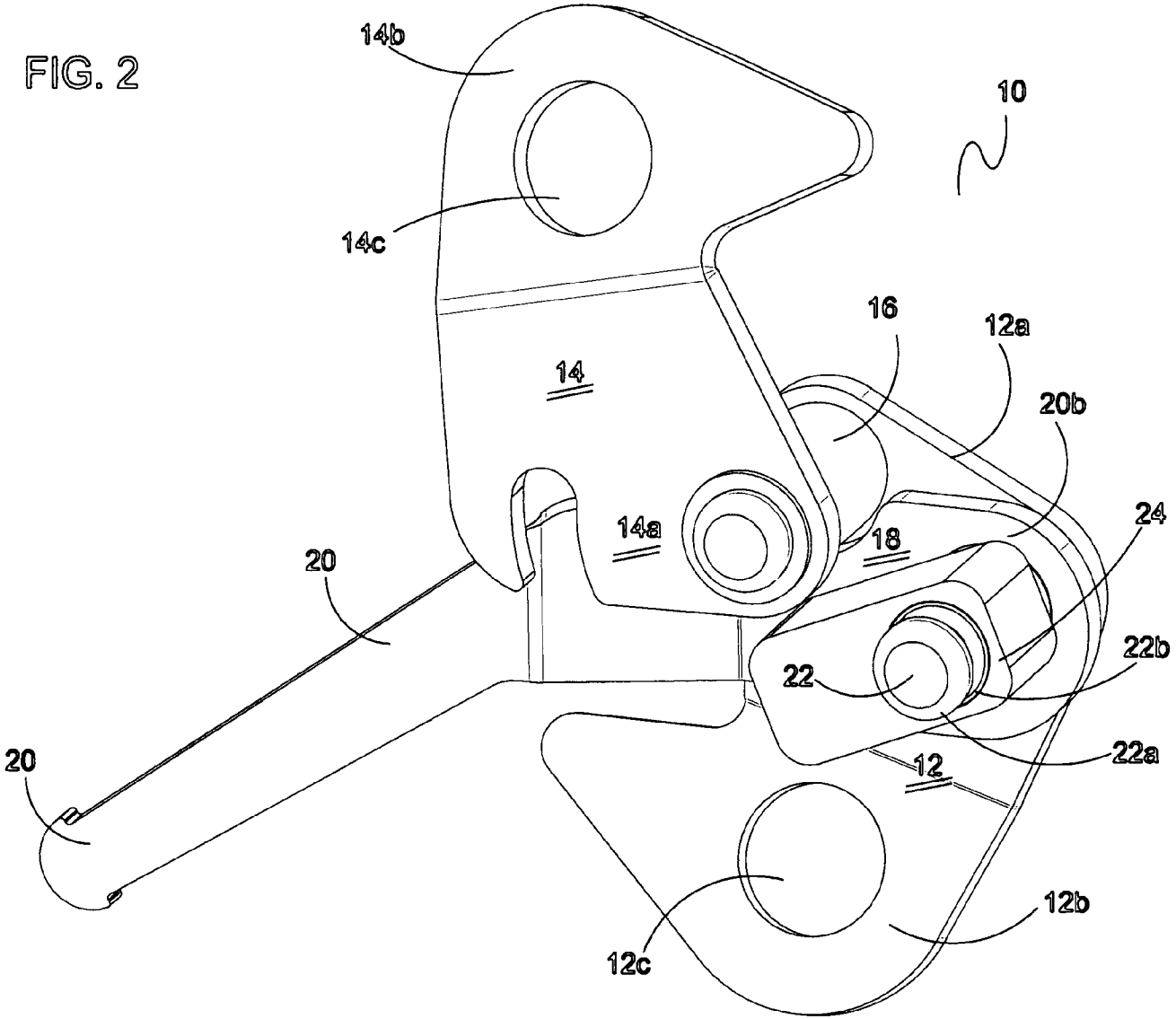
FIG. 2 is a front perspective view of the apparatus for a compact descender according to the preferred embodiment of the present invention, where the device is in the open, or rope loading position.

In FIG. 2 a front perspective view of the ascender device shows the device 10 in the open or rope loading position. Rear plate 12 and front plate 14 are pivotally opened to load a rope (not shown). When loading a rope, the rope will pass through rope channel 18 as is shown loaded in FIG. 7.

Figure 3:
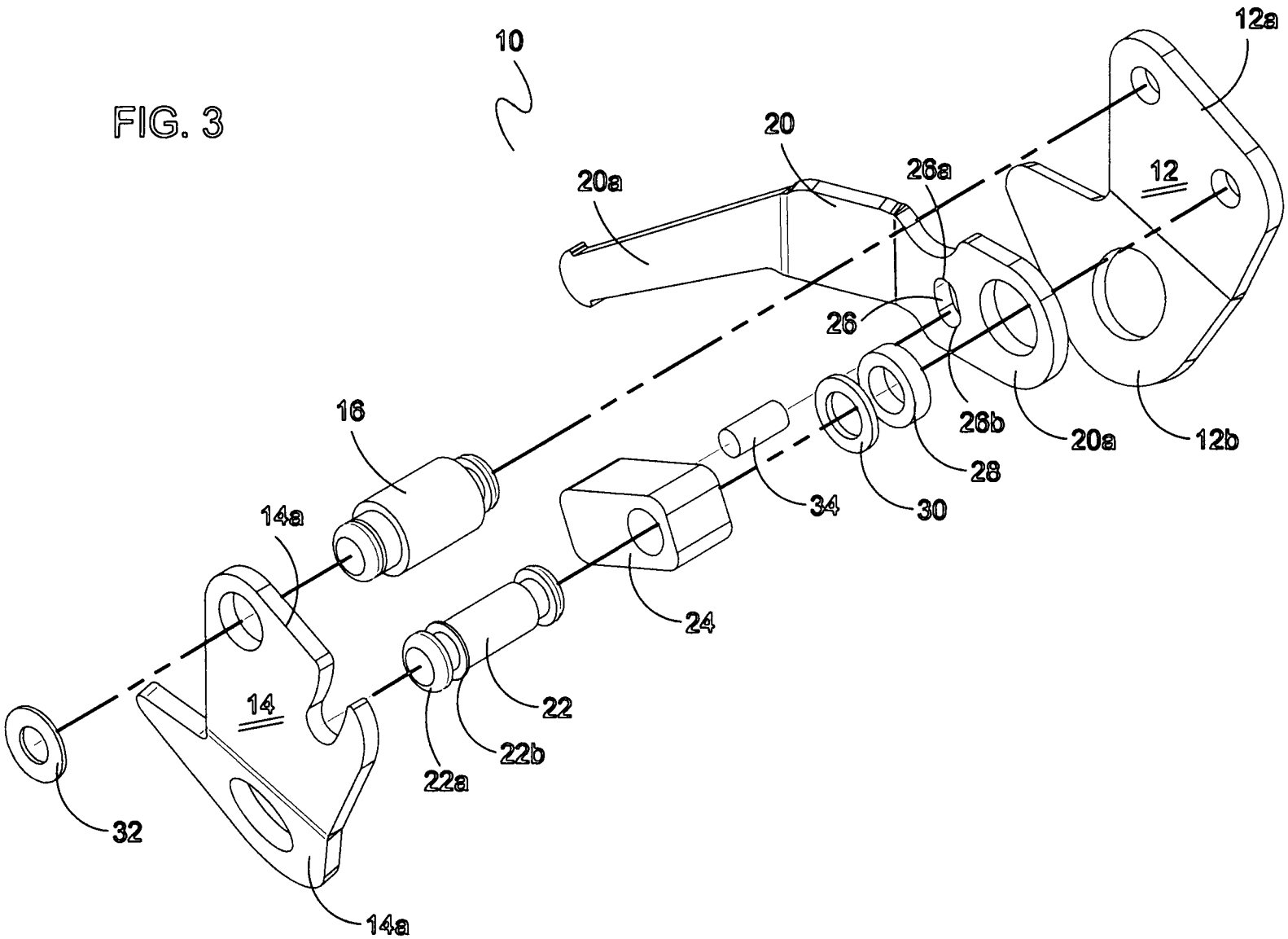
FIG. 3 is an exploded front perspective view shown from above, of the apparatus for a compact descender according to the preferred embodiment of the present invention.
Figure 4:
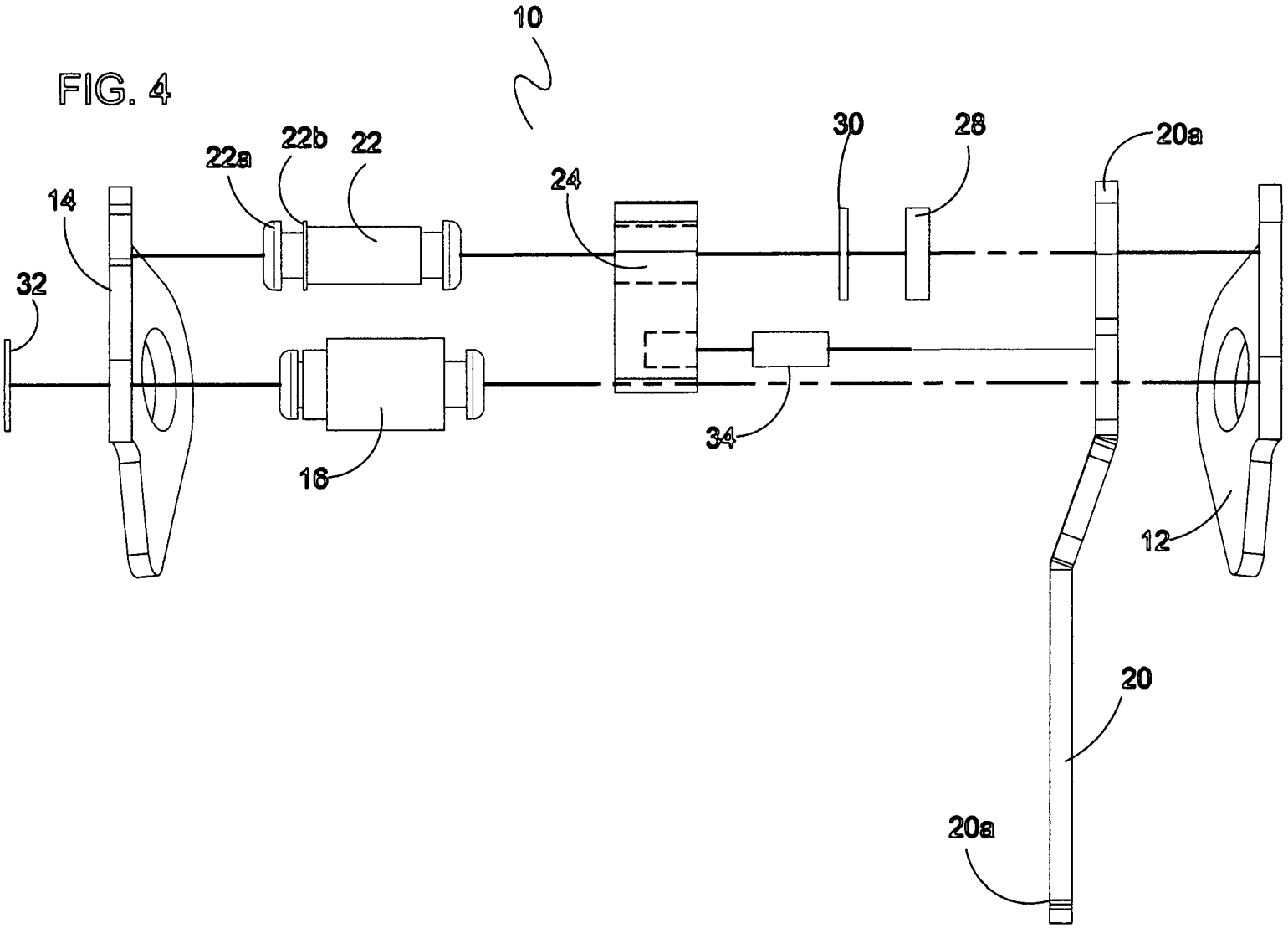
FIG. 4 is an exploded plan view of the apparatus for a compact descender according to the preferred embodiment of the present invention.

FIG. 3 is an exploded front perspective view shown from above, where all the parts of device 10 can be better seen. Note that rope post 16 and pivot pin 22 are shown spun to a mushroomed head, as they would be after assembly of device 10. Lever 20 has a slot 26 end 26*a* and end 26*b*. Also shown in FIG. 3 and FIG. 4 are lever bushing 28 and cam spacer 30 that prevent binding of the lever 20 and cam 24. Lever 20, lever bushing 28 and cam spacer 30 are made of separate materials preferably brass, bronze or stainless steel. Also shown here is a washer 32, where washer 32 prevents front plate 14 from binding to rope post 16 after being spun to a mushroomed head. Washer 32 fits in rope post relieve 16*a*.

FIG. 4 is an exploded plan view, where all the parts can be easily seen. Again, rope post 16 and pivot pin 22 are shown being spun to a mushroomed head as they would be after assembly of device 10. Also shown in FIG. 3 and FIG. 4 pivot pin 22 includes lip 22*b*, where lip 22*b* keeps cam 24 positioned on pin 22, when front plate 14 is open.

Figure 5C:
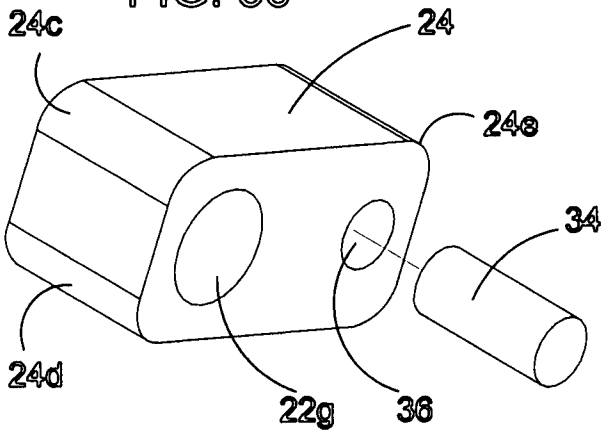
FIG. 5*c* is an exploded perspective view the preferred cam shape showing the dowel pin.
Figure 5D:
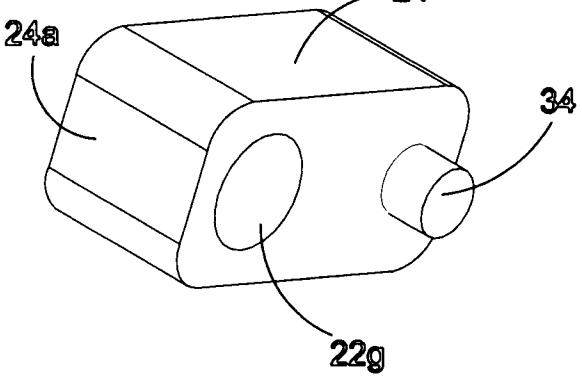
FIG. 5*d* is a perspective view showing the dowel pin pressed into the cam.
Figure 5B:
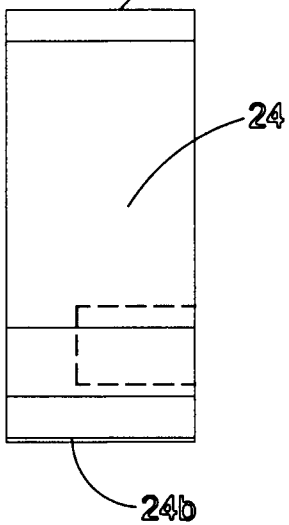
FIG. 5*b* is a side elevational view the preferred cam shape.
Figure 5A:
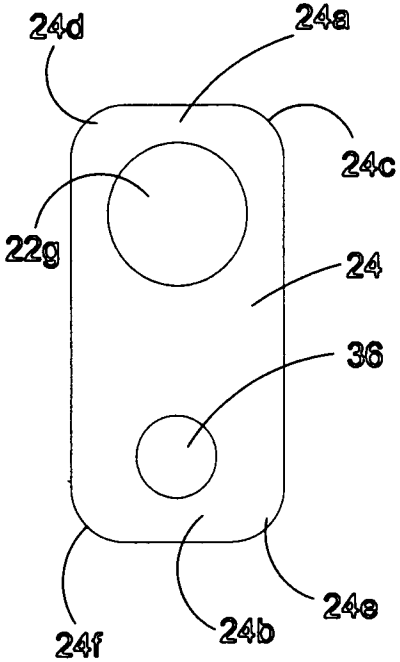
FIG. 5*a* shows a rear elevational view of the preferred cam shape.

FIG. 5*a* shows a rear side elevational view of the rectangular shaped rope clamping cam 24. Rope clamping cam 24 incorporates a radius on corners of the rectangular shape, 24*c*, 24*d*, 24*e* and 24*f*, where the radius is between 10% and 35% of the working width (across the ends 24*a* and 24*b*) of cam 24, where the rope drag or friction is affected. Rope clamping cam 24 includes pivot pin hole 22*g* for mounting cam 24 onto pivot pin 22. FIG. 5*b* is a side elevational view the cam 24, FIG. 5*c* is an exploded perspective view rectangular cam 24, showing a dowel pin 34, and FIG. 5*d* is a perspective view showing dowel pin 34 pressed into hole 36 in cam 24.

Figure 6B:
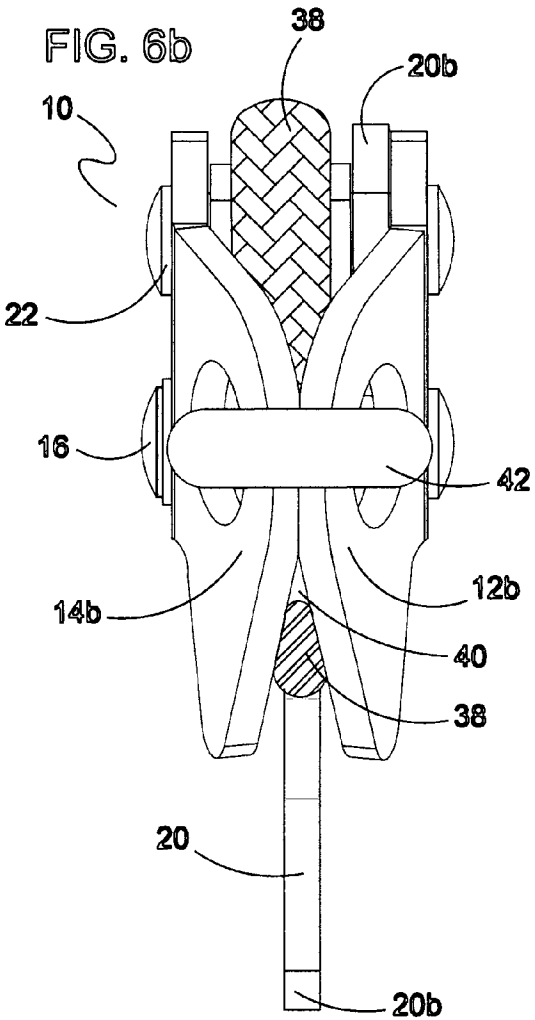
FIG. 6*a* is a side elevation view and 6*b* is a bottom plan view of the apparatus for a compact descender according to the preferred embodiment of the present invention showing how the lever rotates down to press the rope into the V-groove.
Figure 6A:
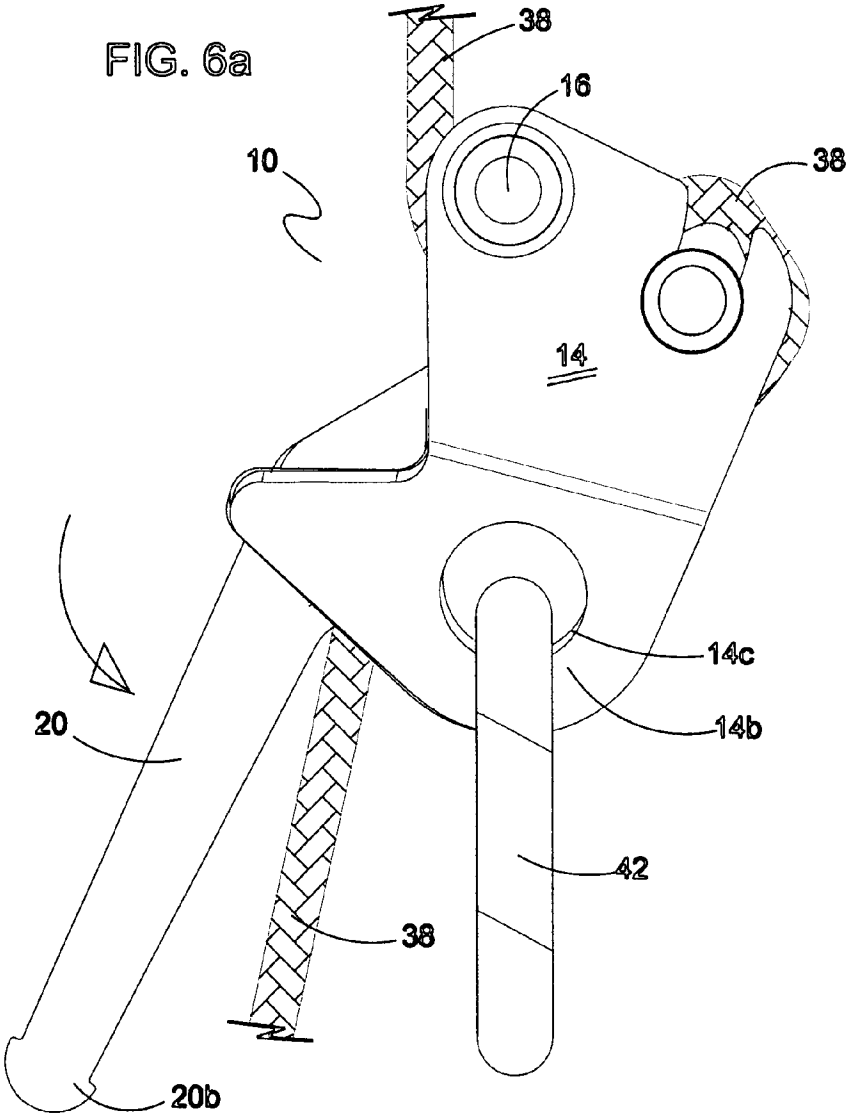

FIG. 6*a* is a side elevation view and 6*b* is a bottom plan view showing how the compound angled lever 20 rotates down to press rope 38 into V-groove 40. Rear plate 12 and front plate 14 are interlocked when closed by means of carabiner 42.

Figure 7:
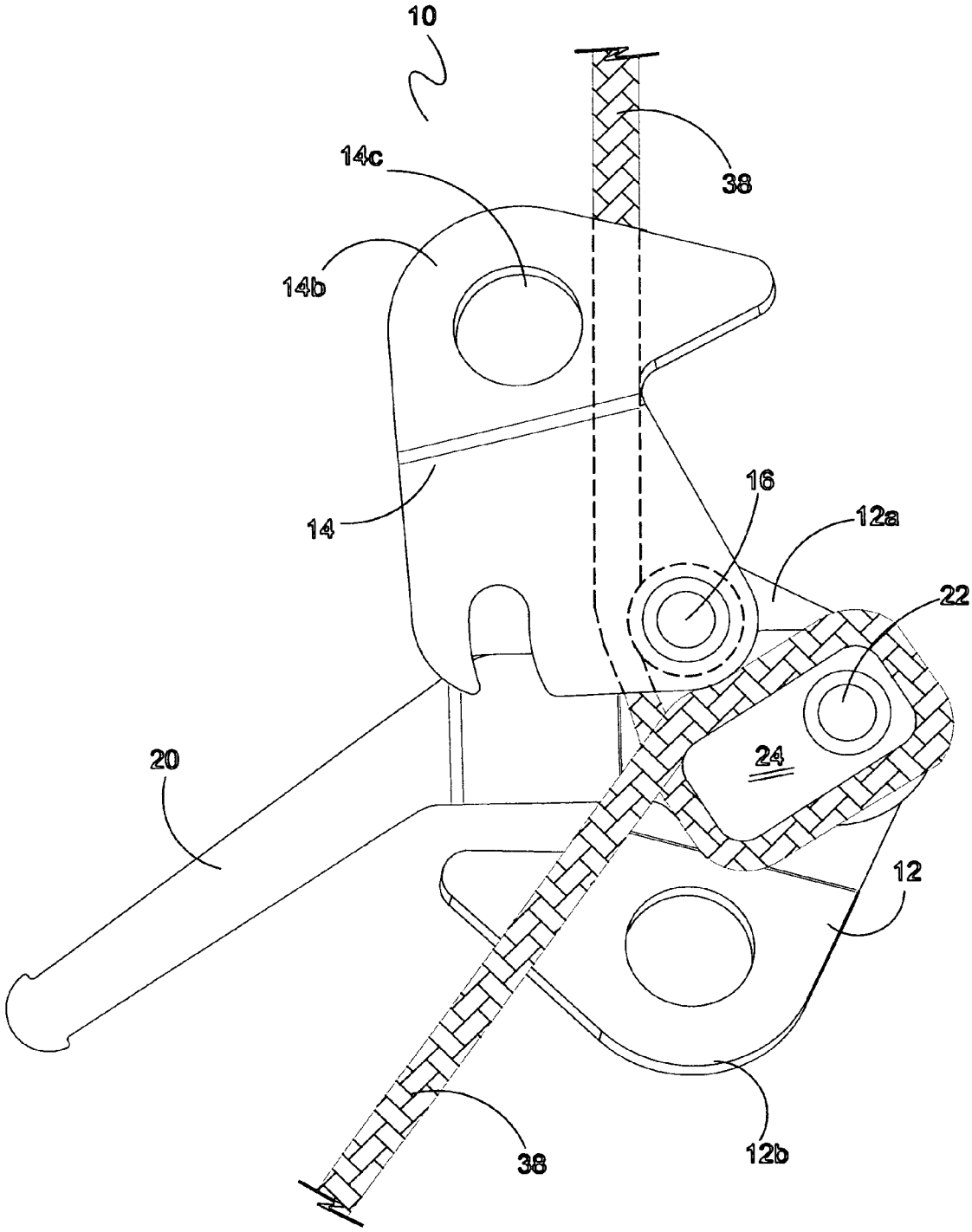
FIG. 7 is a front elevational view of the apparatus for a compact descender according to the preferred embodiment of the present invention, where the device is in the open position, showing a rope loaded in the rope channel, around the cam and passing by the rear plate lower end.

FIG. 7 is a front elevational view, where the device is in the open position showing a rope threaded into rope channel 18, around cam 24 and passing by rear plate lower end 12*b*. Note that rope 38 is wrapped 360 degrees around cam 24. Cam 24 is automatically activated by friction of the rope acting on cam 24, causing rotation of cam 24, with pin 34 moving within slot 26 clamping the rope against rope post 16 without movement of lever 20.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. While the invention has been described in its preferred embodiments, it is to be understood that the words which have been used are words of description and not of limitation. Therefore, changes may be made within the appended claims without departing from the true scope of the invention.

It is intended that the scope of the invention be defined by the Claims appended hereto and their equivalents, which should be given their fair and fullest scope.

What is claimed is:

1. A compact descender apparatus in combination with a rope, comprising:

a first plate and a second plate, said first plate and said second plate respectively having an inside surface, an outside surface, a top end, a bottom end, a left side and a right side, wherein said first plate and said second plate are arranged adjacent to one another with said inside surfaces facing one another, and said first plate and said second plate are pivotally connected with respect to one another by a rope post located at said top ends and said right sides, wherein said first plate and said second plate are capable of pivotally moving between an opened position and a closed position on said rope post;

said first plate has a first hole in said bottom end of said first plate, said second plate has a second hole in said bottom end of said second plate, said holes allowing said first plate and said second plate to be interlocked by attachment of a carabiner passing through said holes when in the closed position;

said first plate and said second plate include a rope channel defined therebetween, wherein a lever is positioned between said first plate and said second plate, said lever having a back surface, a front surface, a handle end and a pivot end, wherein said pivot end of said lever is pivotally affixed by a pivot pin to said inside surface of said first plate, said pivot pin positioned between said first plate and said second plate when in said closed position, wherein said pivot pin is affixed to said inside surface of said first plate adjacent to said rope post and alongside said rope channel, the apparatus having a rope clamping cam adjoined on said front surface of said lever at said pivot end of said lever, said rope clamping cam being pivotally mounted on said pivot pin, said rope clamping cam having a first side, a second side, a pivot end and a clamping end, wherein said clamping end of said clamping cam forces said rope against said rope post when friction is applied by said rope onto said clamping cam;

wherein said apparatus includes a V-groove when in said closed position, said V-groove formed by said left sides of said first plate and said second plate and defined between and extending from said first plate to said second plate, said V-groove positioned near said handle end of said lever after said handle end is rotated downward near said bottoms of said first plate and said second plate while the apparatus is in the closed position, wherein said V-groove is capable of increasing friction on said rope when said rope is actively held against said V-groove when said lever and said clamping cam are selectively rotated away from said rope post, and said rope is capable of being further pressured into said V-groove by further rotation of said lever toward said V-groove, wherein said lever is capable of pivotally moving with respect to said rope clamping cam; and wherein said rope clamping cam is substantially rectangular, and where said rope clamping cam has a radius respectively on four rope contact corners, wherein said radii respectively are between 10% to 35% a length relative to a working width of said substantially rectangular cam.

2. A compact descender apparatus in combination with a rope, comprising:

a first plate and a second plate, said first plate and said second plate respectively having an inside surface, an outside surface, a top end, a bottom end, a left side and a right side, wherein said first plate and said second plate are arranged adjacent to one another with said inside surfaces facing one another, and said first plate and said second plate are pivotally connected with respect to one another by a rope post located at said top ends and said right sides, wherein said first plate and said second plate are capable of pivotally moving between an opened position and a closed position on said rope post;

said first plate has a first hole in said bottom end of said first plate, said second plate has a second hole in said bottom end of said second plate, said holes allowing said first plate and said second plate to be interlocked by attachment of a carabiner passing through said holes when in the closed position;

said first plate and said second plate include a rope channel defined therebetween, wherein a lever is positioned between said first plate and said second plate, said lever having a back surface, a front surface, a handle end and a pivot end, wherein said pivot end of said lever is pivotally affixed by a pivot pin to said inside surface of said first plate, said pivot pin positioned between said first plate and said second plate when in said closed position, wherein said pivot pin is affixed to said inside surface of said first plate adjacent to said rope post and alongside said rope channel, the apparatus having a rope clamping cam adjoined on said front surface of said lever at said pivot end of said lever, said rope clamping cam being pivotally mounted on said pivot pin, said rope clamping cam having a first side, a second side, a pivot end and a clamping end, wherein said clamping end of said clamping cam forces said rope against said rope post when friction is applied by said rope onto said clamping cam;

wherein said apparatus includes a V-groove when in said closed position, said V-groove formed by said left sides of said first plate and said second plate and defined between and extending from said first plate to said second plate, said V-groove positioned near said handle end of said lever after said handle end is rotated downward near said bottoms of said first plate and said second plate while the apparatus is in the closed position, wherein said V-groove is capable of increasing friction on said rope when said rope is actively held against said V-groove when said lever and said clamping cam are selectively rotated away from said rope post, and said rope is capable of being further pressured into said V-groove by further rotation of said lever toward said V-groove; and wherein said rope clamping cam is capable of being partially activated and selectively deactivated rotationally by a dowel pin, said dowel pin being affixed to said first side of said rope clamping cam which is facing said lever, wherein said lever includes a slot adjacent said pivot end of said lever, wherein said slot has a first end and a second end and is of a defined length that allows said rope clamping cam to rotate with respect to said lever via said dowel pin to allow said rope clamping cam to apply a pressure to said rope against said rope post while said lever is being rotated away from the rope post and while force is being applied by said rope to the rope clamping cam to clamp said rope, wherein said second end of said slot in said lever is capable of contacting said dowel pin when said lever is being rotated away from said rope post to rotate said rope clamping cam away from said rope post to release pressure from said rope, said rope being threaded through said rope channel and around said rope clamping cam.

* * * * *